US009659738B2

(12) United States Patent
Heid et al.

(10) Patent No.: US 9,659,738 B2
(45) Date of Patent: May 23, 2017

(54) X-RAY SOURCE AND THE USE THEREOF AND METHOD FOR PRODUCING X-RAYS

(75) Inventors: Oliver Heid, Erlangen (DE); Timothy Hughes, Erlangen (DE); Jennifer Sirtl, Fürth (DE)

(73) Assignee: SIEMENS AKTIENGESELLSCHAFT (DE)

( * ) Notice: Subject to any disclaimer, the term of this patent is extended or adjusted under 35 U.S.C. 154(b) by 277 days.

(21) Appl. No.: 14/407,504

(22) PCT Filed: Jun. 15, 2012

(86) PCT No.: PCT/EP2012/061479
§ 371 (c)(1),
(2), (4) Date: Dec. 12, 2014

(87) PCT Pub. No.: WO2013/185840
PCT Pub. Date: Dec. 19, 2013

(65) Prior Publication Data

US 2015/0170868 A1 Jun. 18, 2015

(51) Int. Cl.
*H01J 35/08* (2006.01)
*H01J 35/18* (2006.01)
*H05G 2/00* (2006.01)

(52) U.S. Cl.
CPC ..... *H01J 35/08* (2013.01); *H01J 35/18* (2013.01); *H01J 2235/082* (2013.01); *H01J 2235/18* (2013.01); *H05G 2/005* (2013.01)

(58) Field of Classification Search
CPC ..... H01J 35/08; H01J 2235/087; H01J 35/16; H01J 2235/081; H01J 2235/186; H01J 35/02
See application file for complete search history.

(56) References Cited

U.S. PATENT DOCUMENTS 6,359,968 B1 3/2002 Harding
2008/0144774 A1 6/2008 Antonis
2012/0057680 A1* 3/2012 Hemberg ..... G03F 7/70033 378/125

FOREIGN PATENT DOCUMENTS

CN 102484934 A 5/2012
DE 19905802 A1 8/2000
(Continued)

OTHER PUBLICATIONS

Bearden J. et al; "Design of a Mercury Vapor Target X-Ray Tube"; Review of Scientific Instruments, AIP, Melville, NJ; vol. 35; No. 12; pp. 1681-1683; ISSN: 0034-6748; DOI: 10.1063/1.1719255; XP002133830; 1964; US; Dec. 1, 1964.
(Continued)

*Primary Examiner* — Hoon Song
(74) *Attorney, Agent, or Firm* — Schmeiser Olsen & Watts LLP

(57) ABSTRACT

An x-ray source comprising a housing, in which a target in the form of an ionized cloud based on metal vapor is provided. The ionized cloud can be excited by means of an electron beam for emitting monochromatic x-rays. The low atom density advantageously produces only a little braking radiation. The robustness of the plasma with respect to the inevitable thermal energy input is also advantageous with respect to the solid target materials. The cloud can be filled at any time with target material which can be vaporized by means of an electric arc. A method for producing x-rays with the above-mentioned x-ray source is also provided. The use of an x-ray source for emitting monochromatic x-rays for x-raying a body is further provided.

11 Claims, 2 Drawing Sheets

(56) References Cited

FOREIGN PATENT DOCUMENTS

Figure 1:
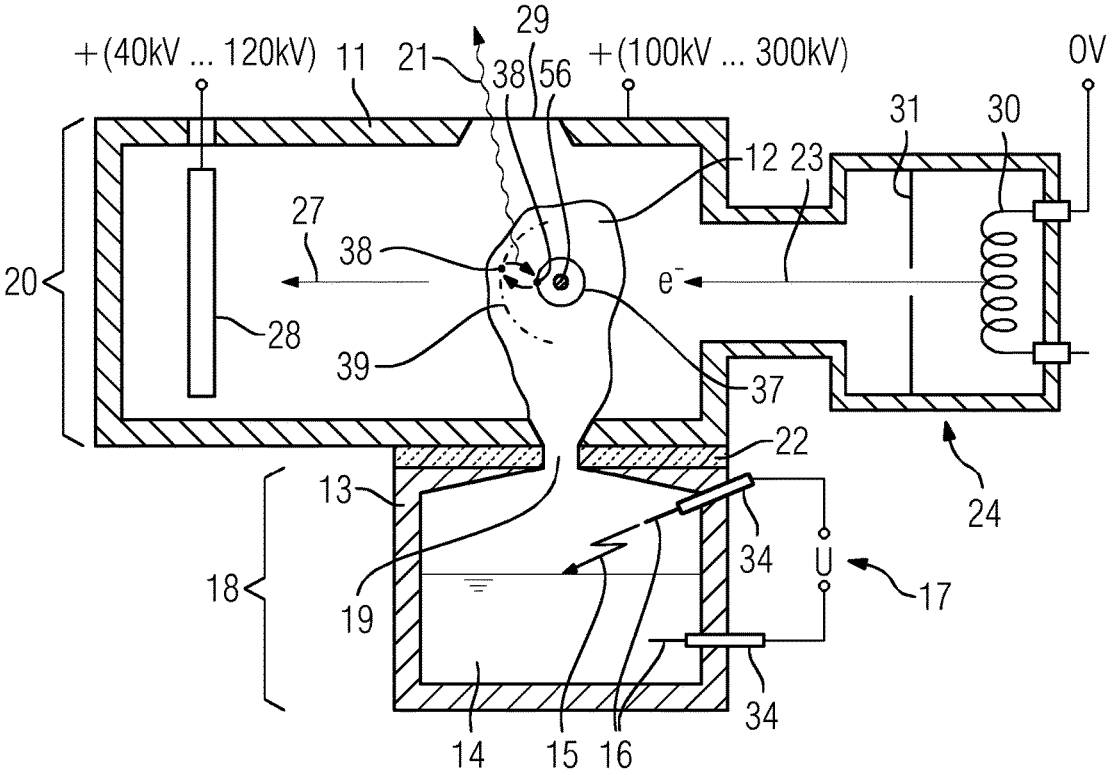

| | | | |
|---|---|---|---|
| DE | 10342239 | A1 | 6/2005 |
| EP | 1028449 | A1 | 8/2000 |
| JP | S63168942 | A | 7/1988 |
| JP | 2000243332 | A | 9/2000 |
| JP | 2002313267 | A | 10/2002 |
| RU | 2010143538 | A | 4/2012 |

OTHER PUBLICATIONS

International Search Report for PCT application No. PCT/EP2012/061479, mailed on Mar. 7, 2013.

* cited by examiner

X-RAY SOURCE AND THE USE THEREOF AND METHOD FOR PRODUCING X-RAYS

CROSS-REFERENCE TO RELATED APPLICATIONS

This application claims priority to PCT Application No. PCT/EP2012/061479 having a filing date of Jun. 15, 2012, the entire contents of which are hereby incorporated by reference.

FIELD OF TECHNOLOGY

The following relates to an X-ray source having a housing in which a target is provided which can emit X-rays when being bombarded with an electron beam. The following additionally relates to a method for producing X-rays, in which a target in a housing of an X-ray source is bombarded with an electron beam. Finally, the following relates to the use of an X-ray source emitting monochromatic X-rays.

BACKGROUND

An X-ray source, the use thereof and a method for producing X-rays of the type mentioned in the introduction are disclosed, for example, in US 2008/0144774 A1. According to said document, an X-ray source can be realized by way of example by arranging electrodes within a housing. In the housing, an electron beam is produced by an electrode having a potential of 0 V. An anode, which is used as a target for the electron radiation, is arranged opposite said electrode. Said anode is at 100 kV. Located downstream of the anode is furthermore a collector which is at a potential of 10 kV. When the electron beam strikes the anode, X-rays are released which can be coupled out of the housing through a suitable window (transparent to X-rays) and be supplied for use.

The anode serving as a target can be configured as a thin-walled structure. By way of example, the anode may have a base plate made of boron, having a thickness of between 10 and 200 μm. A thin layer of tungsten having a layer thickness of 0.1 to 5 μm, which is used as a target, is applied on said base plate. However, the very thin tungsten layer is exposed to a high degree of stress on account of the electron beam.

In addition, according to DE 103 42 239 A1, an apparatus for producing soft X-rays, for example, with an electrically driven discharge is described. In this case, a laser beam is used to vaporize a supplied medium. The medium used can be, for example, a metal melt applied on the external surface of two electrodes. A plasma is ignited in the vapor using the electrodes, and the X-rays are coupled out.

SUMMARY

An aspect relates to improving the X-ray source mentioned in the introduction such that a relatively long operating time of the X-ray source is possible without the target needing to be replaced. A further aspect relates to specifying a method for operating said X-ray source. Finally, an aspect relates to finding a use for such an X-ray source.

Embodiments of the invention in include a plasma acting as an anode that can be produced in the housing in the form of an ionized metal vapor as the target, wherein a target material and a vaporizer apparatus for producing the metal vapor are provided in the housing. The target material may be solid or liquid. It is vaporized by the vaporizer apparatus such that a metal vapor is produced in the housing. In the metal vapor, which can be exposed to a high voltage in the housing, X-rays can be produced through bombardment with an electron beam.

A further aspect relates to a method for producing X-rays indicated in the introduction, wherein a metal vapor is produced as a target in a vaporizer apparatus, wherein a target material is provided for producing the metal vapor.

Finally, an aspect also relates to by the use of an X-ray source, which emits monochromatic X-rays, for X-raying a body which forms differentiable contrasts at the wavelength of the X-rays used. The body may be a mechanical body, such as for example, a component connection that is to be examined for defects in the connection. Another possibility is to examine a human or animal body. In any case, the wavelength of the monochromatic X-rays must be selected suitably so that contrasts form. The use of monochromatic X-rays as compared to X-rays having a wavelength spectrum has the advantage that sharper images can be produced, which allows more detailed statements regarding the examined object to be made.

According to an advantageous embodiment of the invention, provision is made for the housing to have a vaporization chamber for a metal to be vaporized, which vaporization chamber is connected via an opening, preferably a nozzle, to a residual volume of the housing. This construction has the advantage that the metal vapor can be metered relatively accurately via the nozzle. It is also possible to influence the shape of the cloud, for example by way of the nozzle form. Finally, the vaporization chamber is advantageously separated from the residual volume of the housing. This facilitates cleaning measures, for example, which become necessary in parts of the housing owing to the fact that the metal vapor can deposit itself on the chamber walls.

According to another embodiment of the invention, provision is made for an electrode to be provided as the vaporizer apparatus for igniting an arc between the electrode and the target material. This vaporizer apparatus is located in the housing, in which the resulting metal vapor is also intended to be excited by the electron beam to emit X-rays. An advantage that should be mentioned here is that such a housing unit is simple in terms of construction. For example, if soiling occurs on account of the deposition of metal vapor, said housing unit can simply be replaced.

In the simplest case, it is also sufficient to use a simple electrode as the electron emitter. The target in plasma form is excited by a high-current discharge originating from the electrode.

It is an advantage that a window is arranged in the wall of the housing, which window is transparent for the X-rays to be produced. The resulting X-rays can advantageously be coupled out of the housing through said window and be supplied for a planned use.

According to one advantageous embodiment of the invention, provision is made for the metal vapor to consist of a light metal or a plurality of light metals, preferably aluminum. Light metals within the context of the application are meant to designate metals and the alloys thereof, the density of which is below 5 g/cm$^3$. Specifically, said definition applies to the following light metals: all alkali metals, all alkaline earth metals except for radium, in addition scandium, yttrium, titanium and aluminum. Further advantageous material groups for forming the metal vapor are tungsten, molybdenum and the group of the lanthanides. When selecting the target material, the emission spectrum of the K-shell is crucial. This is advantageously adapted using the application. Specifically, this is the element lanthanum and the 14 elements following lanthanum in the periodic table.

The use of metal vapor also has the advantage that, due to the excitation of the target using the electron beam, monochromatic X-rays can advantageously be produced. These are X-rays having only one wavelength, which has the advantage that X-radiographs can be imaged more sharply with monochromatic X-rays, for example. It is therefore also an alternative way of achieving embodiments of the invention to use said monochromatic X-rays for X-raying a body, which body must be of a nature such that, at the wavelength of the used monochromatic X-rays, contrasts of the body appear on the image. The body may be a mechanical structure (mechanical or inanimate body), such as for example a component connection that is to be examined for inflow of air. Another possibility is to record X-radiographs of a human or animal body.

BRIEF DESCRIPTION

Figure 2:
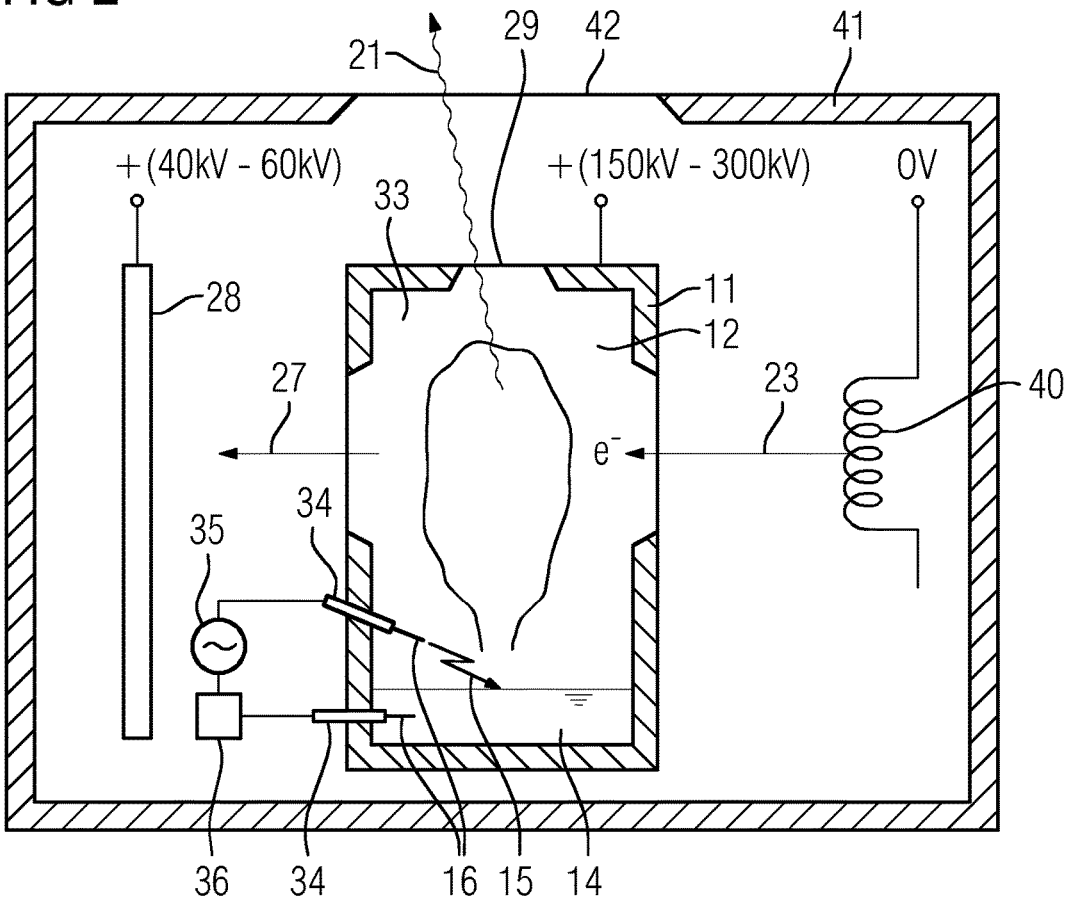

Some of the embodiments will be described in detail, with reference to the following figures, wherein like designations denote like members, wherein:

FIG. 1 shows an exemplary embodiment of the X-ray source in schematic section with a separate vaporization chamber and a housing for receiving the metal vapor; and FIG. 2 shows a further exemplary embodiment of the X-ray source in which the target material is vaporized and the cloud is received in that same housing body, in schematic section.

DETAILED DESCRIPTION

Illustrated in FIG. 1 is an X-ray source, in which a housing 11 is provided, in which a cloud 12 of metal vapor can be produced as the target for X-rays 21. Adjacent to said housing 12 is a vaporization chamber 13, in which a liquid target material 14 is vaporized using an arc 15. The target material can be liquefied even before vaporization by the introduction of energy of the arc 15. In order to be able to ignite the arc 15, electrodes 16 and a voltage source 17 are provided. The vaporizer apparatus 18 formed by the vaporization chamber 13 is made complete by a nozzle 19, with said nozzle being formed in the partition between a production space 20, formed by the housing 11, for a monochromatic X-ray beam 21 and the vaporization chamber 13. The housing 11 is separated from the vaporization chamber 13 by an electrically insulating layer 22.

In order to produce an electron beam 23, an electron gun 24 is provided, wherein the electron beam 23 passes into the housing 11. The electron beam interacts with the gaseous target and is electrostatically decelerated and collected by a collector 28. Finally, a window 29 is provided, through which the X-rays 21 which are produced can be coupled out of the housing 11.

The electron gun 24 has a cathode 30, which is at a potential of 0 V. It emits the electron beam 23, which is, focused by a lens 31, coupled out of the electron gun. The driving force here is a potential which is established by the ionized, gaseous target to be made to have a potential of +100 to +300 kV. The collector 28 is at a potential of between +40 and +120 kV.

FIG. 2 illustrates an alternative embodiment of the X-ray source. The housing 11 used here only has one housing space 33, which acts both as the vaporizer apparatus 18 and as the production space 20 according to FIG. 1. At the bottom of the housing 11 is the target material 14, which is likewise melted and vaporized by the electrodes 16 by way of the arc 15. As in FIG. 1, the electrodes 16 are electrically insulated from the remaining housing by insulators 34. The electrodes 16 according to FIG. 2 are supplied by an AC voltage source 35, wherein the arc is stabilized by a ballast 36. Stabilization of the arc is necessary so that the cloud used as the target is replenished continuously with vaporized target material. This is because the embodiment according to FIG. 2 lacks a metering apparatus like nozzle 19 according to FIG. 1.

However, the X-ray beam 21 is produced in the same way as described in FIG. 1. This is also illustrated in more detail in FIG. 1. In this case, a lanthanum atom with its nucleus 56 is illustrated by way of example. Also illustrated is the K-shell 37 of the atom, on which an electron 38 is located. This electron is excited by excitation of the electron beam and raised to a higher shell 39. When it jumps back, it emits the monochromatic X-rays 21.

The electron emitter used is, according to FIG. 2, not an electron gun 24 but a simple electrode 40, wherein this electrode 40 is, as already described in FIG. 1, at a potential of 0 V. Both the electrode 40 and the collector 28 are arranged in an external housing 41, which has an additional window 42, by way of which the X-rays 21 are coupled out. The housing 11 is simply placed inside the external housing 41. Advantageously, a plurality of the housings 11 can be kept in storage, for example in order to allow fast replacement if the housing 11 needs to be cleaned or if the target material 14 is used up. It is advantageously also possible for a plurality of housings with different target materials 14 to be kept in storage, so as to be in a position to quickly modify the X-ray source for producing monochromatic X-rays of different wavelengths. In principle, such modification is, of course, also possible in the construction according to FIG. 1.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements.

The invention claimed is:

1. An X-ray source having a housing, in which a target is provided that emits X-rays when being bombarded with an electron beam, wherein an ionized metal vapor is produced in the housing as the target, wherein a target material and a vaporizer apparatus for producing the metal vapor are provided in the housing;

wherein an electrode is provided as the vaporizer apparatus for igniting an arc between the electrode and the target material.

2. The X-ray source as claimed in claim 1, wherein the housing has a vaporization chamber for a metal to be vaporized, the vaporization chamber being connected via an opening to a residual volume of the housing.

3. The X-ray source as claimed in claim 1, wherein the housing has a first window in a wall of the housing, the first window being transparent for the electron beam.

4. The X-ray source as claimed in claim 1, wherein a window is arranged in a wall of the housing, the window being transparent for the X-rays to be produced.

5. The X-ray source as claimed in claim 1, wherein the target material comprises a light metal.

6. The X-ray source as claimed in one of claim 1, wherein the target material comprises a lanthanide, tungsten, molybdenum or an alloy of at least two thereof.

7. A method comprising:

utilizing an X-ray source emitting monochromatic X-rays as claimed in claim 1 for X-raying a body, which forms differentiable contrasts at a wavelength of the X-rays used.

8. The X-ray source as claimed in claim 2, wherein the opening is a nozzle.

9. The X-ray source as claimed in claim 5, wherein the target material is aluminum.

10. A method for producing X-rays, in which a target in a housing of an X-ray source is bombarded with an electron beam and emits X-rays, wherein a metal vapor is produced in the housing as the target in a vaporizer apparatus, wherein a target material is provided for producing the metal vapor;

wherein an electrode is provided as the vaporizer apparatus for igniting an arc between the electrode and the target material.

11. The method as claimed in claim 10, wherein monochromatic X-rays are produced with the target.

* * * * *